United States Patent [19]

Young et al.

[11] 4,289,419

[45] Sep. 15, 1981

[54] INERTIAL BARRIER SYSTEM

[75] Inventors: Bruce O. Young; Wan Seegmiller, both of Sacramento, Calif.

[73] Assignee: Energy Absorption Systems, Inc., Chicago, Ill.

[21] Appl. No.: 80,766

[22] Filed: Oct. 1, 1979

[51] Int. Cl.[3] ..... E01F 15/00

[52] U.S. Cl. ..... 404/6; 256/13.1; 267/139; 116/63 R

[58] Field of Search ..... 404/6; 256/1, 13.1; 267/139, 116; 116/63

[56] References Cited

U.S. PATENT DOCUMENTS

| | | | |
|---|---|---|---|
| Re. 29,544 | 2/1978 | Fitch | 256/13.1 |
| 3,288,440 | 11/1966 | Schimmelpenninck | 256/13.1 |
| 3,591,144 | 7/1971 | Iving | 256/13.1 |
| 3,606,258 | 9/1971 | Fitch | 404/6 X |
| 3,704,861 | 12/1972 | Glaesener | 256/13.1 |
| 3,856,268 | 12/1974 | Fitch | 404/6 X |
| 3,880,404 | 4/1975 | Fitch | 404/6 X |
| 3,916,816 | 11/1975 | Fitch | 40/125 H X |
| 4,073,482 | 2/1978 | Seegmiller | 267/139 |
| 4,101,115 | 7/1978 | Meinzer | 404/6 X |
| 4,118,014 | 10/1978 | Frosch | 256/13.1 X |

OTHER PUBLICATIONS

"Firerglass Median Barrier", May 1971, Technical Memo 505-14, Texas Trans. Institute.

*Primary Examiner*—Nile C. Byers, Jr.

*Attorney, Agent, or Firm*—Hume, Clement, Brinks, Willian & Olds, Ltd.

[57] ABSTRACT

An inertial barrier system for attenuating the energy of errant vehicles. The system includes module means defining a frangible container having a generally inverted U-shaped configuration with an opened and enlarged upper portion and a closed lower portion. The upper and lower container portions receive a continuous mass of dispersible energy-attenuating material, and maintain the center of gravity of the mass above the lower portion of the container. This lower portion also defines a central void of substantial volume, for receiving a portion of the dispersible mass during the initial impact of the module means by an errant vehicle. Cover means are provided to close the module.

13 Claims, 10 Drawing Figures

INERTIAL BARRIER SYSTEM

BACKGROUND AND GENERAL DESCRIPTION

This invention relates to an inertial barrier system for attenuating the energy of errant vehicles.

It is well known that many obstructions located next to the roadbeds of highways create safety hazards. These obstructions take the form of overpass support columns, bridge abutments, guardrails, road signs, railings, and the like. Since the existence of these hazards have been recognized, a continuous effort is being made to provide suitable energy attenuation devices in front of the obstructions, in the potential path of travel of an errant vehicle, in an effort to substantially reduce damage to the vehicles and personal injury to the passengers.

Prior devices which use sand or other forms of readily dispersible particulate material as the energy-attenuating medium, for placement before roadbed articles, are shown in U.S. Pat. No. 3,606,258 to J. C. Fitch, entitled "Energy Absorbing Deceleration Barrier". Another type of energy-attenuation device using sand or other dispersible particulate material is disclosed in U.S. Pat. No. 4,073,482 issued to Wan Seegmiller and Bruce O. Young, entitled "Inertial Barrier System". The inertial barrier system of the present invention is a modification or improvement of the barrier systems described in these foregoing U.S. patents.

For example, these foregoing patents discuss the problem of "ramping" of an errant vehicle, i.e. the tendency of the vehicle to rise over an energy-attenuation system and overturn, due to the accumulation of debris below the center of gravity of the vehicle. These patents also generally discuss the opposite problem of "nose diving", where the vehicle tends to flip because the front is forced down. The wellknown technique for minimizing ramping or nose diving is to locate the center of gravity of the dispersible energy absorbing mass essentially in a direct line with the average center of gravity of the moving vehicle; for example, approximately 22–25 inches above the road surface. This location of the mass center of gravity tends to eliminate the development of a force couple which would ramp or nose dive the errant vehicle. The inertial barrier system in accordance with the present invention incorporates this feature of preventing ramping or nose diving by elevating the center of gravity of the mass essentially in line with the average center of gravity of the errant vehicle.

The foregoing U.S. Pat. No. 4,073,482 also describes a system which minimizes environmental degradation of the system, due to the prolonged effects of roadside vibrations and the like. This degradation of the system is also precluded by the present invention. To accomplish this feature, the present system substantially eliminates the possibility of shifting of the dispersible matter downwardly, and the resulting undesirable lowering of the center of gravity of the dispersible mass below the designed center of gravity for the system.

Further, the present energy attenuation system precludes degradation by providing containers which receive a mass of dispersible energy-attenuating material, such as sand, continuously throughout the entire container height. This design eliminates the interposition of lightweight module components between the major portion of the dispersible mass and the support surface, which has been found to cause undesirable movement or "walking" of the container and a downward shifting of the mass.

In addition, the present invention accomplishes the foregoing advantages in a manner which reduces the number of component parts of the system. In one form of the system, for example, the number of component parts of each module is reduced to two, including a protective covering lid. In addition to the economical advantages resulting from a reduction of component parts, the present invention thereby provides a reduced amount of material that might be dispersed, upon impact by an errant vehicle, into traffic lanes, where it could cause a secondary accident.

In addition, this invention enhances the functional operation of the inertial barrier modules by providing each module with a substantial void in its lower portion which assists in properly elevating the center of gravity of the mass. Also, the void allows the dispersion of a portion of the sand or other dispersible mass contained in the module into the void, upon the initial impact by the errant vehicle. This initial transfer of a portion of the mass into the void permits earlier dispersion of the mass, and tends to lower the peak stopping force applied to the errant vehicle by the module. This feature also provides a more uniform 'G' load on the vehicle, by allowing the mass to disperse almost immediately upon impact, rather than having substantial dispersal await the fracture of all wall portions of the module. Additionally, the interior of each module in accordance with this invention is shaped to tend to project a portion of the mass vertically when impact occurs. This vertical component of mass distribution also ameliorates the peak of 'G' load applied to the impacting vehicle by the modules.

Briefly, the above-described features and advantages of the present invention are accomplished by an inertial barrier system which provides at least one module. The module defines a frangible container having a generally inverted U-shaped type configuration. The container wall portions are preferably integral, to provide a leakproof container for a dispersible mass such as sand. The upper portion of the container is enlarged and opened, to receive the dispersible mass. The lower portion of the container has a substantially reduced cross-sectional area, and defines a central void of substantial volume. Preferably, this void is circular or cylindrical in configuration, and is defined by annular portions of the container which extend downwardly to the supporting surface.

The upper and lower portions of the container cooperate to receive a dispersible mass such as sand continuously throughout the entire container height. The container also maintains the mass in a manner which elevates the center of gravity of the mass into the enlarged upper portion. The void in the lower portion assures that the center of the gravity of the mass is so elevated. The void also is adapted to receive a portion of the mass as it is dispersed upon impact. A container cover, preferably made from plastic material, is fitted over the top of each container.

EXEMPLARY EMBODIMENTS

Further objects and features of the present invention will become more apparent from the following description of exemplary embodiments thereof, taken in conjunction with the accompanying drawings in which.

Figure 1:
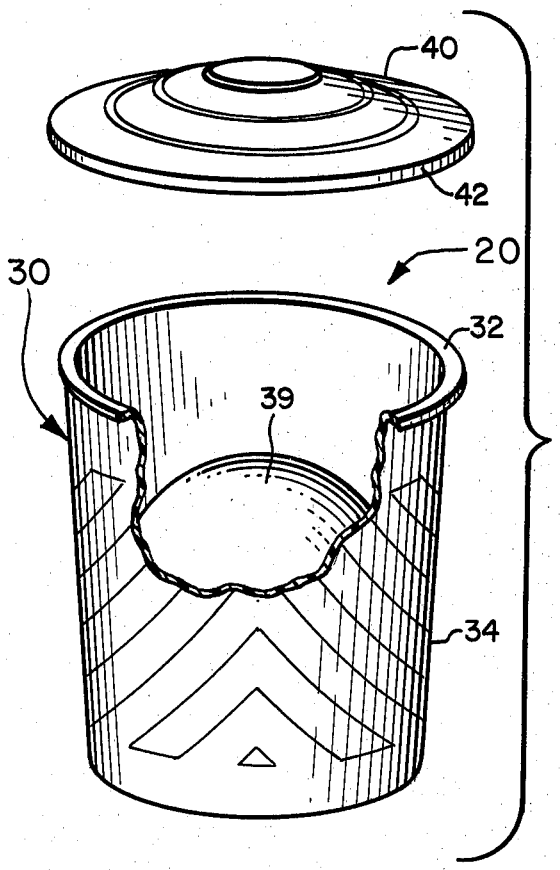
FIG. 1 is an exploded perspective view showing the components of a two-piece module comprising one embodiment of the energy attenuating system in accordance with this invention.

A module in accordance with the present invention, adapted to receive approximately 700 pounds of sand, is indicated generally by the reference numeral 20 in the FIG. 1. The module 20 is a simplified design including only two component parts; a container 30 and a cover 40. These components 30 and 40 are formed from a frangible material so that they do not interfere with the absorption of energy by the dispersible mass contained within the module 20 during impact of the module by an errant vehicle. Suitable frangible materials for the module 20 are polypropylene or foamed high-density polyethylene.

As seen in FIG. 1, the illustrated container 30 incorporated in the module 20 is generally cylindrical in configuration. A downturned rim 42 on the lid 40 snaps over a rim flange 32 provided around the top of the container 30. The cover 40 protects the contents of the container 30 from the elements, and can be readily removed to fill or inspect the interior of the container.

Figure 2:
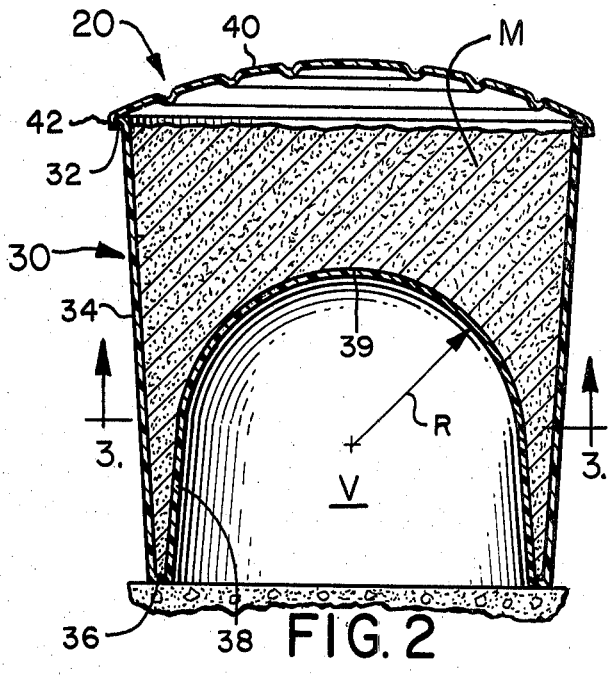
FIG. 2 is cross-sectional view of the module illustrated in FIG. 1, shown in assembled form and filled with a selected charge of dispersible energy attenuating material.

The outer wall 34 of the container 30, in the illustrated embodiment, is a continuous cylindrical wall member which is tapered inwardly and downwardly. This inward tapering facilitates the stacking of the containers 30 when not in use, and the removal of the containers from the mold during manufacture. The exterior wall member 34 can be painted or embossed with safety chevrons or the like, to increase the visibility of the module assembly 20. The container 30 also includes an integral bottom wall member 36 which rests upon a supporting surface S, as seen in FIG. 2. The bottom wall 36 thereby provides the container 30 with a continuous annular supporting area in direct contact with the support surface S. Any movement or vibrational energy of this support surface S will be transmitted to the mass in the container 30 directly through the bottom wall member 36. The integral construction of the bottom wall 36 also prevents leakage of dispersible material from the container 30 during use.

The lower portion of the container 30 in accordance with this invention is provided with a substantial void 'V' which is free from the dispersible mass, such as sand, included within the container 30. The void 'V' is defined by an internal wall member 38 of the container 30. As seen in FIG. 2, a portion of this internal wall member 38 is generally inwardly tapering and frusto conical in configuration. In the embodiment shown in FIG. 2, the top portion of the internal wall member 38 defines a generally hemispherical support surface 39, having a selected radius 'R'.

Figure 3:
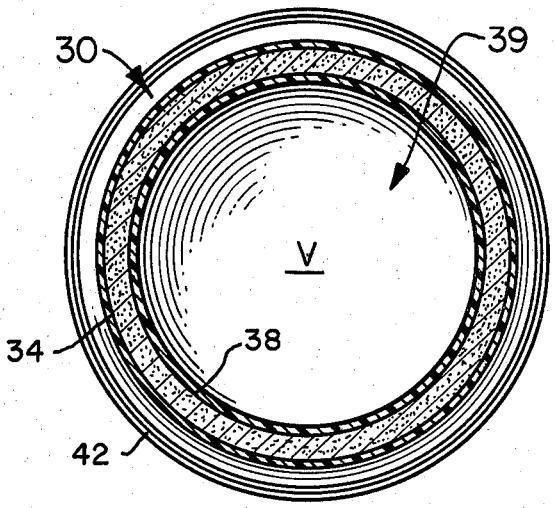
FIG. 3 is a cross-sectional view taken along the line 3—3 in FIG. 2, illustrating the central void defined by the modules in accordance with the present invention.

The inner wall member 38 is integral with the bottom wall 36 and thereby defines a container 30 which will receive a charge of dispersible material 'M' throughout the container height. The tapering of the wall members 34 and 38 gradiently increases the mass of dispersible material in the container 30 in a vertically upward direction, and also facilitates the formation of the inner wall 38 by a mold core. The dimensions and configuration of the container 30 shown in FIGS. 1–3 are selected so that the module 20 will contain approximately 700 pounds of sand or other dispersible material 'M'. The dome shaped support surface 39 supports a major portion of the material 'M' in the upper portion of the container 30 so that the center of gravity of the mass of material is elevated above the lower portion of the container 30.

Figure 4:
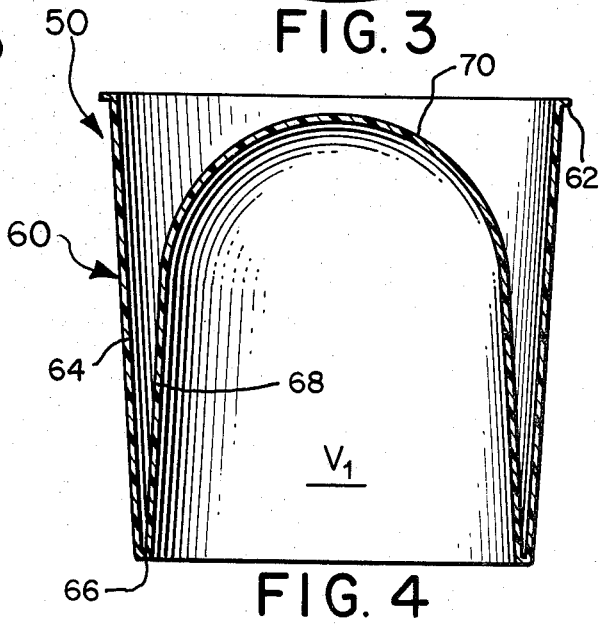
FIG. 4 is a cross-sectional elevational view of a second module which is adapted to receive a charge of dispersible energy attenuating material selectively smaller than the charge received by the module illustrated in FIGS. 1 and 2.

A second embodiment of a module 50 in accordance with this invention is illustrated in FIG. 4. This modified module 50 has a construction similar to the above-described module 20. A cover 40 (See FIG. 1) is adapted to be fitted over the rim 62 of the container 60 incorporated in the module 50. The container 60 has a downwardly tapered outer wall 64 and an annular bottom wall 66. The void $V_1$ in the lower portion of the container 60 is provided by an interior wall 68 having a frusto conical lower section integrally connected to the bottom wall 66. A hemispherical section 70 of the inner wall 68 defines a support surface for the dispersible mass 'M'.

In the embodiment shown in FIG. 4, the volume of void '$V_1$' is increased over the volume of void 'V' shown in FIG. 2. To accomplish this change the height of the wall section 38 is increased to elevate the hemispherical support section 70 above the section 39 in FIG. 2. The container 60 thus will receive and support a smaller volume of sand or other dispersible material, as compared to the above-described container 30. The illustrated container 60 is designed to contain approximately 400 pounds of sand, with an elevated center of gravity of the mass. Of course, the dimensions of the container 60 can be varied in different respects, to vary the mass of the dispersible material within the container 60 to suit particular installation requirements.

The above-described modules 20 and 50 provide containers 30 and 60 each of which maintain a dispersible mass 'M' so that the center of gravity of the mass is elevated into alignment with the average center of gravity of the errant vehicle which might impact the containers. Furthermore, the design of the containers 30 and 60 assures that the dispersible mass 'M' is continuous throughout the height of the containers. Vibrational energy at the support surface S is therefore transmitted directly to the mass 'M' through the bottom walls 36 and 66. Any degradation of the condition of the modules 20 and 50 due to such vibrational energy, is therefore substantially reduced.

The containers 30 and 60 also define the central voids 'V' and '$V_1$' in a lower portion of the containers. These voids function to assure that the center of gravity of the mass 'M' is elevated, as described above. The voids furthermore provide a space into which a portion of the mass 'M' can disperse upon the initial impact of the containers 30 and 60 by an errant vehicle. The dispersal of the mass 'M' can begin, and the transfer of momentum from the errant vehicle to the dispersible mass can be initiated, before the entire container is fractured. The provision of these voids 'V' and '$V_1$', thus lower the peak stopping force needed to attenuate the energy of the car, and provide a more uniform 'G' load on the impacting vehicle. These functions are also enhanced by the tendency of a portion of the mass 'M' to disperse upwardly upon impact.

The design of the containers 30 and 60 in the preferred form provides a two-piece module. This reduces the amount of frangible material available upon impact, and likewise reduces the possibility of a secondary accident caused by flying debris from the containers.

Figure 5:
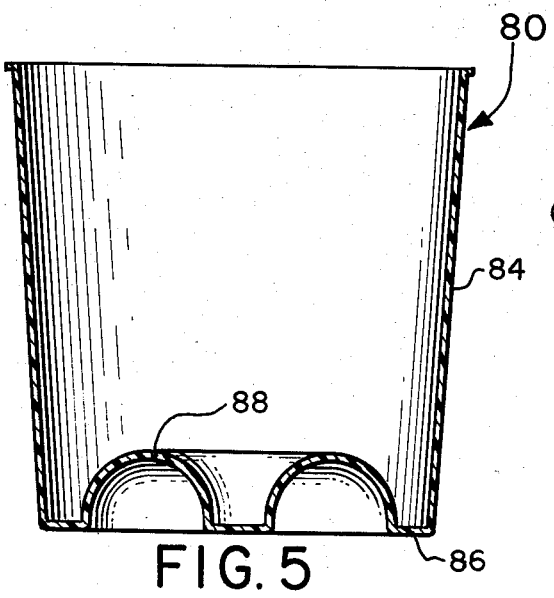
FIG. 5 is a cross-sectional elevational view of a third module which is adapted to receive a charge of energy attenuating material selectively larger than the charge received by the modules shown in FIGS. 1–4.

The container 80 illustrated in FIG. 5 is designed to be substantially filled with a dispersible material such as sand. This container includes side walls 84 of tapering configuration, and a bottom wall 86. This bottom wall 86 includes a hemispherical annulus 88 which tends to elevate the center of gravity of the dispersible mass 'M' within the container 80. In the illustrated embodiment, the container 80 is designed to received approximately 1400 pounds of sand. In use, the 1400 pound container 80 is positioned at the rear of the array of modules, as illustrated in FIG. 6, to increase the mass of sand in the array, and to tend to stop an errant vehicle before impact with an obstruction 'O'.

Figure 6:
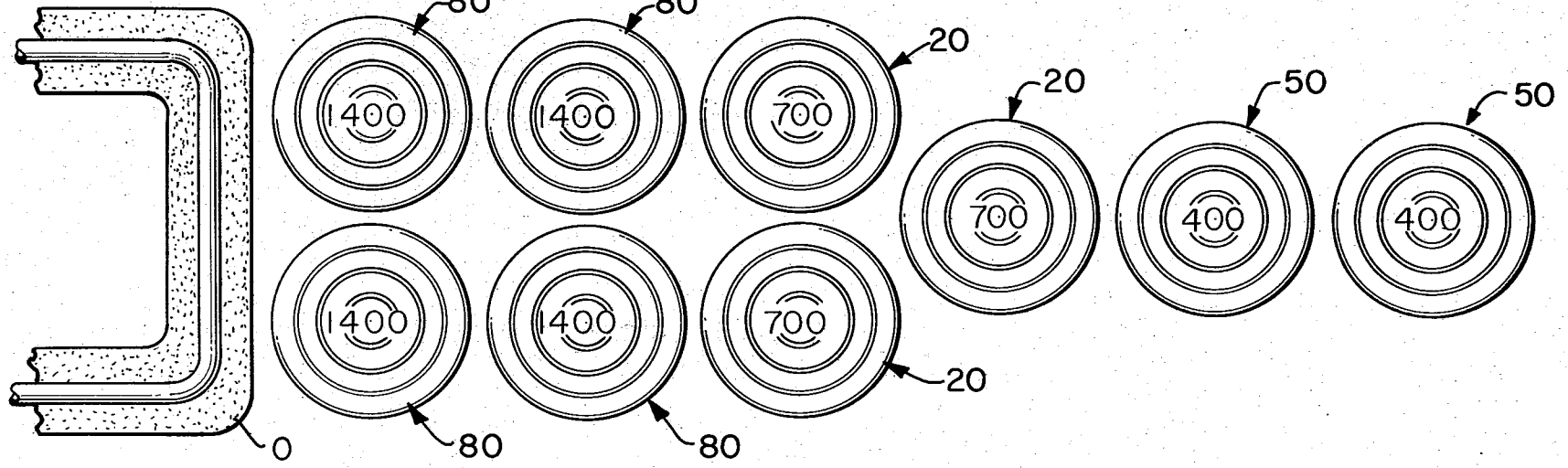
FIG. 6 is a plan view illustrating an array of energy attenuating modules arranged in front of a roadbed obstacle in accordance with the present invention.
Figure 7:
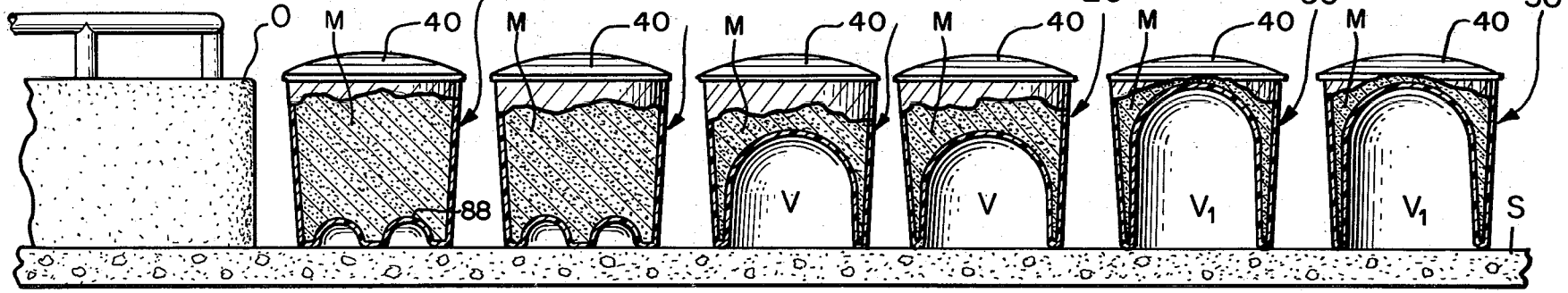
FIG. 7 is an elevational view of the module array illustrated in FIG. 6, with portions of the modules shown in section to illustrate the design of the modules to provide the array with gradiently varying energy attentuation characteristics.

FIGS. 6 and 7 illustrate an array of a plurality of module assemblies in front of a road obstacle 'O'. A gradient increase in energy attenuation is produced in this array by selectively varying the mass 'M' contained in this successive module assemblies. To accomplish this result, the initial modules in the array are the modules 50 containing about 400 pounds of sand (See FIG. 4). These initial modules 50 have a relatively small mass, and cause a relatively small amount of energy attenuation during the initial impact of the vehicle with the modules. The next series of modules in the array are the 700 pound modules 20, as illustrated in FIGS. 1–3. The increased mass of these modules 20 increases the energy attenuation of the errant vehicle, as compared to the effect of the modules 50. Energy attenuation can be further enhanced by providing two or more modules 20 in rows in the array, as seen in FIG. 6.

Finally, the array or barrier may be provided with a series of modules 80, such as illustrated in FIG. 5. These modules 80 are designed to contain approximately 1400 pounds of sand. They thus provide a substantial degree of energy attenuation, and assist in urging the errant vehicle to a cushioned stop before impacting the roadside obstacle 'O'.

FIG. 7 illustrates the ease with which the gradiently increasing energy attenuating characteristics can be provided in the array by the modules in accordance with this invention. The different modules such as modules 20 and 50, can be placed along the array, and filled with different masses of sand or the like. In each module, the center of gravity of the mass 'M' is located approximately in line with the center of gravity of the errant vehicle. The array therefore gradiently attenuates the energy of the vehicle without any substantial tendency toward ramping or nose-diving, as described above.

Figure 10:
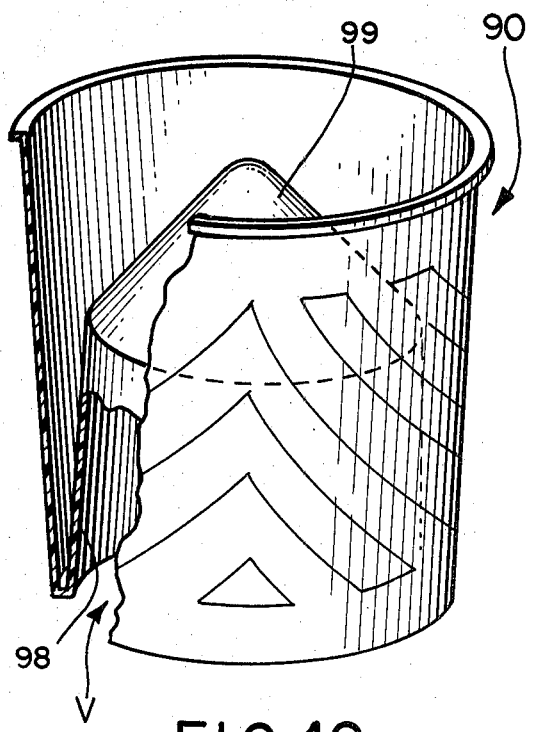
FIG. 10 is a perspective view in partial cross-section of a still further modification of the module shown in FIG. 1, where a dome-shaped portion of the inner wall is modified to be conically shaped.

The modified container 90 shown in FIG. 10 is constructed in a manner similar to the container 30 having the dome-shaped inner support surface 39, as shown in FIG. 2. However, the interior wall 98 and the container 90, as shown in FIG. 10, terminates in a conically-shaped support surface 99. In other respects, the construction of the container 90 is similar to the container 30. In either case, the containers 30 and 90 function in the same manner as described above. These containers 30 and 90 elevate the center of gravity of the dispersible mass 'M'; provide a continuous mass throughout the height of the container; and provide a central void 'V' into which the mass can disperse upon initial impact.

Figure 8:
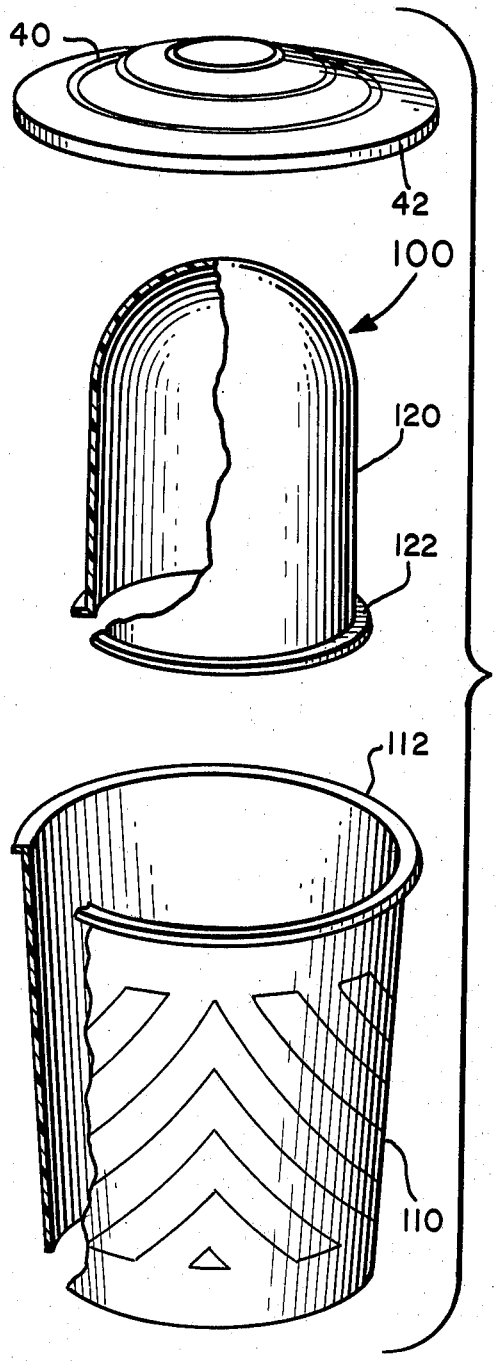
FIG. 8 is an exploded perspective view, in partial cross-section, of a further embodiment of the module in accordance with separate inside and outside wall structures.
Figure 9:
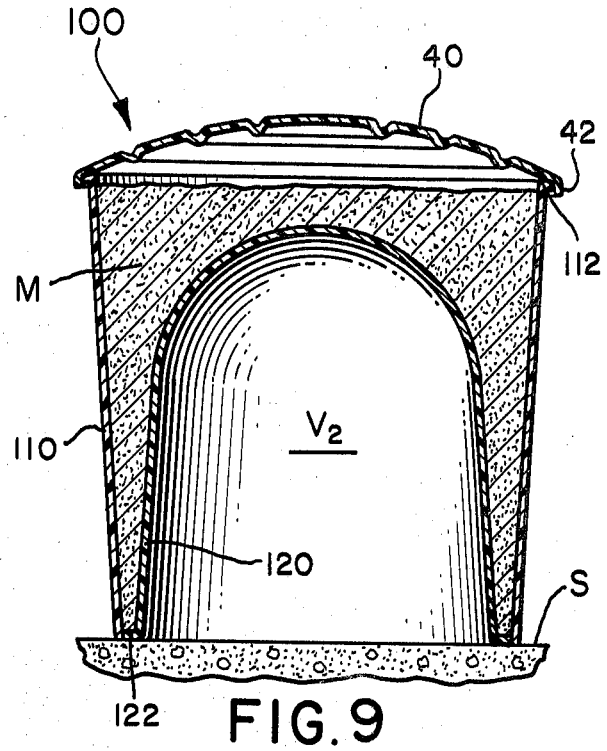
FIG. 9 is a cross-sectional elevational view of the module modification shown in FIG. 8, illustrating the final assembly of the inside and outside wall structures of the module.

FIGS. 8 and 9 illustrate a further modification of a module 100 in accordance with this invention. To permit the use of different molding and manufacturing techniques, the module 100 is an assembly of three component parts. The cover 40 is the same as described above for modules 20, 50 and 80. The lower container portion in this embodiment is formed from an outer cylindrical stabilizer section 110 and a dome-shaped interior section 120. A rim 112 on the stabilizer section 110 receives the rim 42 on the cover 40. The side portions of the stabilizer section 110 are tapered downwardly, as seen in FIG. 8, and the bottom portion is open.

The interior section 120 is dimensioned for insertion within the stabilizer section 110. As seen in FIG. 9, a lower flange 122 abuts against the section 110 and defines a bottom wall for the module 100. The interior section 120 defines a void '$V_2$' similar in function to the voids 'V' and '$V_1$' described above. A dispersible mass 'M' hence can be maintained within the module 100, with an elevated center of gravity.

In operation, the module 100 would function in the same manner as described above to attenuate the energy of a vehicle. The extent of the mass 'M' within the module 100 can be varied by varying the dimensions of the interior section 120, to change the volume of the void '$V_2$'.

Although the invention has been described above with a certain degree of particularity with respect to several embodiments, it should be understood that this disclosure has been made only by way of example. Numerous changes in the details of construction and the combination of arrangement of the components, as well as possible modes of utilization for the inertial barrier system in accordance with this invention will be apparent to those familiar with the art, and may be resorted to without departing from the scope of the invention.

We claim:

1. An inertial barrier system for attenuating the energy of errant vehicles comprising:

module means defining a frangible container having a generally inverted U-shaped configuration with an opened and enlarged upper portion having a selected relatively large volume and a closed lower portion having a relatively small volume, said upper and lower container portions adapted for receiving a continuous mass of dispersible energy-attentuating material within the module means and for maintaining said material so that the center of gravity of said mass is above said lower portion, said lower portion of said container defining a central void of substantial volume for receiving a portion of the dispersible mass during the initial impact of said module means by an errant vehicle; and means to cover said upper opened portion of said module means.

2. An inertial barrier system in accordance with claim 1 wherein said upper and lower portions of said container are integrally formed so that said container and cover means provide a two-piece module means.

3. An inertial barrier system in accordance with claim 2 wherein said container includes outer wall means of generally cylindrical configuration; bottom wall means of generally annular configuration integral with said outer wall; and inner wall means having a downwardly opening concave configuration integral with said bottom wall member and defining said central void within the lower portion of said container.

4. An inertial barrier system in accordance with claim 3 wherein said outer wall means tapers generally inwardly and downwardly, and said inner wall means tapers inwardly and upwardly, whereby said walls cooperate to define a container for said dispersible mass which is continuous throughout the container height and which gradiently increases in mass toward the upper portion of said container.

5. An inertial barrier system in accordance with claim 3 wherein the upper portion of said inner wall means defines an integral dome-shaped support surface for said dispersible mass in the upper portion of said container.

6. An inertial barrier system in accordance with claim 3 wherein the upper portion of said inner wall means defines an integral conical support surface for said dispersible mass in the upper portion of said container.

7. An inertial barrier system in accordance with claim 1 wherein said container means includes a generally cylindrical outer wall member and a downwardly opening concave inner wall member for insertion within said outer wall member.

8. An inertial barrier system in accordance with claim 7 wherein the upper end of said inner wall member defines a dome-shaped supporting surface for said dispersible mass in the upper portion of said container.

9. An inertial barrier system in accordance with claim 8 wherein the upper end of said inner wall member defines a conical support surface for said dispersible mass in the upper portion of said container.

10. An inertial barrier system for attenuating the energy of errant vehicles comprising:

a plurality of module means arranged in a selected array adjacent a hazard in the path of travel of a vehicle, each of said module means including a frangible container having a generally inverted U-shaped configuration with an opened and enlarged upper portion having a relatively large volume and a lower portion having a relatively small volume so that each container is adapted to receive a continuous mass of dispersible energy-attenuating material and to maintain the center of gravity of said mass above said lower portion, the lower portion of each of said containers further defining a central void of substantial volume for receiving a portion of the dispersing energy-attenuating material upon the initial impact of the errant vehicle against the frangible containers; and means to cover said opened portion of each container.

11. An inertial barrier system in accordance with claim 10 wherein the mass of energy-attenuating material within said containers is varied along the path of travel of said vehicle to provide said array with gradiently increasing energy-attenuation characteristics.

12. An inertial barrier system in accordance with claim 11 wherein said mass is varied in said system by decreasing the volume of the central void provided in the lower portion of said containers and thereby increasing the mass of material in said containers along the path of travel of said errant vehicles.

13. An inertial barrier system in accordance with claim 12 wherein said barrier system includes at least one end module means containing energy-attenuating material substantially throughout its entire length, and arranged at the end of said array, whereby said end module tends to bring the errant vehicle to a cushioned stop prior to impact with said hazard.

* * * * *

UNITED STATES PATENT AND TRADEMARK OFFICE

CERTIFICATE OF CORRECTION

PATENT NO. : 4,289,419

DATED : September 15, 1981

INVENTOR(S) : Bruce O. Young and Wan Seegmiller

It is certified that error appears in the above—identified patent and that said Letters Patent is hereby corrected as shown below:

On Page 1, under "Other Publications", delete "Firerglass" and insert therefor --Fiberglass--.

Column 1, line 37, delete "wellknown" and insert therefor --well-known--.

Column 3, line 28, delete "attentuation" and insert therefor --attenuation--.

Column 4, line 45, delete "$V_1$" and insert therefor --'$V_1$'--.

Column 6, line 11, delete "nose-diving" and insert therefor --nose diving--.

Signed and Sealed this

*Fifth* Day of *January 1982*

[SEAL]

*Attest:*

GERALD J. MOSSINGHOFF

*Attesting Officer*

*Commissioner of Patents and Trademarks*